US006928970B2

(12) United States Patent
Sebastian

(10) Patent No.: US 6,928,970 B2
(45) Date of Patent: Aug. 16, 2005

(54) DEVICE FOR THE VARIABLE CONTROL OF GAS EXCHANGE VALVES IN AN INTERNAL COMBUSTION ENGINE

(75) Inventor: Thomas Sebastian, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/399,965

(22) PCT Filed: Jun. 8, 2002

(86) PCT No.: PCT/DE02/02092

§ 371 (c)(1),
(2), (4) Date: Feb. 24, 2004

(87) PCT Pub. No.: WO03/018964

PCT Pub. Date: Mar. 6, 2003

(65) Prior Publication Data

US 2005/0056243 A1 Mar. 17, 2005

(30) Foreign Application Priority Data

Aug. 24, 2001 (DE) ..... 101 41 605

(51) Int. Cl.[7] ..... F01L 1/34

(52) U.S. Cl. ..... 123/90.16; 123/90.15; 123/90.6

(58) Field of Search ..... 123/90.16, 90.15, 123/90.6

(56) References Cited

U.S. PATENT DOCUMENTS

| | | | | |
|---|---|---|---|---|
| 4,886,022 A | | 12/1989 | Nakai | |
| 5,253,546 A | | 10/1993 | Elrod et al. | |
| 5,404,770 A | | 4/1995 | Kruger | |
| 5,404,844 A | * | 4/1995 | Schechter | 123/90.12 |
| 5,505,168 A | * | 4/1996 | Nagai et al. | 123/90.17 |

FOREIGN PATENT DOCUMENTS

| | | |
|---|---|---|
| DE | 37 05 128 A1 | 9/1988 |
| GB | 239579 | 9/1925 |
| WO | WO 95/23912 | 9/1995 |

* cited by examiner

*Primary Examiner*—Thomas Denion
*Assistant Examiner*—Zelalem Eshete
(74) *Attorney, Agent, or Firm*—Ronald E. Greigg

(57) ABSTRACT

The invention relates to a device for variable control of the gas exchange valves of an internal combustion engine, of which at least one gas exchange valve is triggered by a cam of a camshaft, which cam has a cam contour with a circular portion of the cam bottom and a cam apex portion. For variably adjusting the cam contour, a pressure-fluid-actuated piston guided by the cam and retractable and extensible radially continuously, is provided which on its end forms at least a part of the cam apex portion.

18 Claims, 1 Drawing Sheet

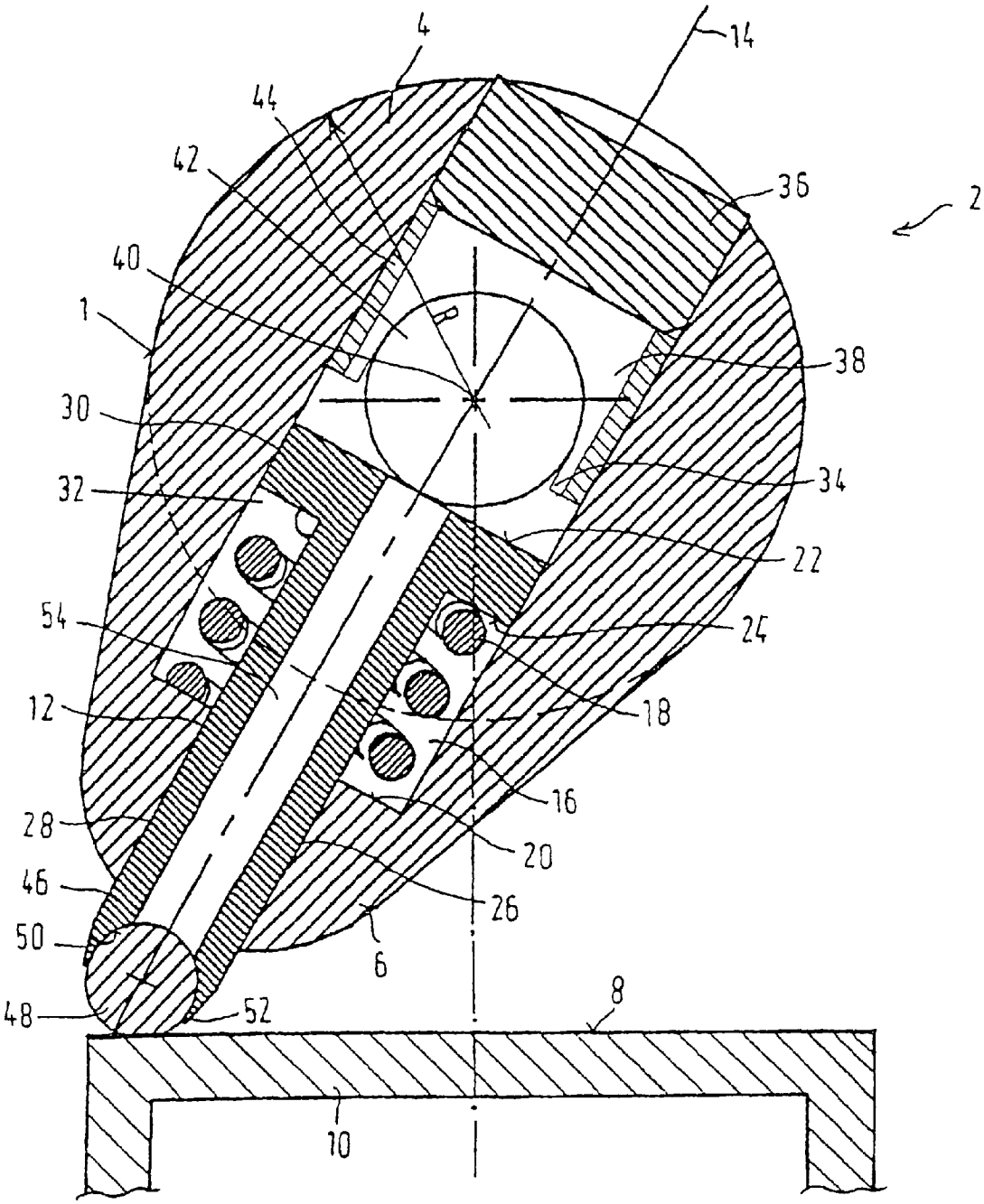
4
14
44
42
36
2
40
1
38
30
34
32
22
54
24
12
18
16
28
20
46
26
50
6
48
52
8
10

DEVICE FOR THE VARIABLE CONTROL OF GAS EXCHANGE VALVES IN AN INTERNAL COMBUSTION ENGINE

CROSS-REFERENCE TO RELATED APPLICATIONS

This application is a 35 USC 371 application of PCT/DE 02/02092 filed on Jun. 8, 2002.

BACKGROUND OF THE INVENTION

1. Field of the Invention

The invention is directed to an improved device for variable control of the gas exchange valves of an internal combustion engine, of which at least one gas exchange valve is triggered by a cam of a camshaft, which cam has a cam contour with a circular portion of the cam bottom and a cam apex portion.

2. Description of the Prior Art

The prior art discloses various attempts at realizing a variable control of gas exchange valves. On the one hand, partly variable valve control devices are known in which the valve strokes are variable in stages. One such valve control device is described for instance in European Patent Disclosure EP 0 515 520 B1, which has a tappet made up of two concentric cup elements, of which the inner one rests with one face end on the valve shaft of the gas exchange valve. The tappet cooperates with the cam of a camshaft that has three partial cams with different cam paths. The two outer cam paths have the same stroke course and act on the outer cup element. The middle partial cam has a stroke course deviating from that, with a lesser stroke height, and acts on the inner cup element. The two concentric cup elements can be coupled to one another by hydraulic action of a coupling element, or in a second switching position of this coupling element, they can be moved independently of one another. In the coupled position, the two cup elements are connected to one another, so that they follow the stroke course of the partial cams with a longer stroke. Via the coupling element and the inner cup element, this motion is transmitted to the valve shaft. In the second switching position of the coupling element, the two cup elements are movable independently of one another. The valve shaft cooperates in this switching position with the middle partial cam with a shorter stroke. The outer cup element follows the stroke motion of the outer partial cam, but there is no connection with the inner cup element or the valve shaft. An advantage of such valve drives is that even if the switching mechanism fails, proper valve control is still assured by the camshaft; moreover, conventional internal combustion engines can be equipped without overly great effort. A disadvantage, however, is that the valve strokes and control times are variable in only a limited number of stages, and the staged transition creates problems in terms of noise and operating smoothness. Moreover, such systems are mechanically complicated.

Also from the prior art, such as German Patent Disclosure DE 39 35 218 A1, fully variable valve control devices in the form of electrohydraulic valve drives without a camshaft are known, in which the valve shaft is coupled via a piston rod to a hydraulically actuatable differential piston, by way of which the individual gas exchange valve is actuatable directly, independently of the other gas exchange valves. Consequently, continuously variable valve strokes and variable control times can be achieved for each gas exchange valve. For actuating the differential piston, two control valves per gas exchange valve are used, so that in the four-valve engines that are common at present, eight such control valves per cylinder are needed; because of the high number of components, this has an adverse effect both on the installation space required and on the production costs. Moreover, conventional internal combustion engines can be retrofitted with the new technology only at relatively great effort. Emergency operation properties represent a particular problem, since as a rule, failure of the hydraulic system also causes a total failure of the valve control.

SUMMARY OF THE INVENTION

Depending on the pressure conditions of the pressure fluid, the piston can be extended out of or retracted into the associated cam. Thus the cam contour of the cam is continuously variable, so that arbitrary stroke curves of the gas exchange valves are attainable. In particular, the stroke height, the valve opening time, and the valve opening speed can be adjusted continuously variably. Since the retractable and extensible pistons are supported displaceably in the otherwise unmodified cams, and no changes to the tappets are required, conventional valve drives can be retrofitted with only slight modifications. Moreover, because of the integration with the cams, no additional installation space for the pistons is required, resulting in a very small demand for space. Since the camshaft is entirely preserved as a control device, the function of the valve control is assured even if the pressure fluid supply fails. Overall, with the invention, an extremely economical valve drive can be achieved, compared to the prior art.

In a very particularly preferred provision, the cam apex end of the piston is embodied spherically. The cam apex can then roll on the associated tappet with little friction in any angular position.

It is also especially advantageous that the piston is kept in a defined position if the pressure fluid supply fails. As a result, the engine can continue to be operated with predetermined control times and valve strokes, without the possibility that damaging operating states will occur.

Preferably, a ball that is capable of rolling on a rolling face of a tappet that cooperates with the applicable cam is rotatably supported on the end of the piston toward the cam apex. As a result, friction losses and wear between the tappet and cam are reduced considerably. For supporting the ball, a spherical bearing face corresponding to the radius of the ball is preferably embodied on the end of the piston toward the cam apex, and its edge is crimped radially inward in order to grasp the ball. Advantageously, the bearing face of the ball is supplied with lubricant oil by the already existing lubricant oil system of the engine, so that between the bearing face, a hydrodynamic film of lubricant that is favorable in terms of both friction and wear can develop.

In a further preferred provision, the piston in the cam is actuated by lubricant oil of the engine. Since in an internal combustion engine, lubricant oil under pressure is already present, it is possible to dispense with an additional hydraulic supply of pressure fluid for piston actuation.

In a preferred way, the piston is guided linearly by the cam. The radial position of the piston, which varies the valve stroke and the control times of the associated gas exchange valve, is preferably adjustable as a function of the force equilibrium between spring forces that urge the piston radially inward and pressure forces of the lubricant oil that urge it radially outward.

For guiding the piston in the cam, a continuous stepped bore extending in the direction of the center axis of the cam is provided, and a helical spring is braced on one end on a step, toward the cam apex, of the stepped bore and on the other on an annular face of the piston pointing away from an action face on the base of the piston.

In a refinement, between the action face of the piston and a stopper piece inserted into the end of the stepped bore pointing away from the cam apex portion, a pressure chamber for the lubricant oil is embodied, which communicates with a lubricant oil conduit that is coaxial with the camshaft axis. For realizing hydrodynamic lubrication at the bearing face of the ball, the piston has a conduit connecting the bearing face with the pressure chamber.

A bush inserted into the stepped bore is braced on the stopper piece and serves as a radially inner stop for the piston if the engine is stopped or if the pressure fluid supply fails. Then the helical spring urges the piston toward the bush, so that the piston is kept in a defined position.

The pressure buildup or pressure reduction in the pressure chambers of the cams that are provided with retractable and extensible pistons is preferably effected by means of a valve assembly that contains one switching valve upstream of the lubricant oil conduit of the camshaft and one switching valve downstream of the lubricant oil conduit.

BRIEF DESCRIPTION OF THE DRAWINGS

One exemplary embodiment of the invention is described in further detail herein below in conjunction with the sole drawing FIGURE which is a cross-sectional view of a device according to the invention for variable control of the gas exchange valves of an internal combustion engine.

DESCRIPTION OF THE PREFERRED EMBODIMENT

In the drawing, for reasons of scale, all that is shown of a device for variable control of the gas exchange valves of an internal combustion engine is one of a plurality of cams 1 of a camshaft 2, in cross section. The cam contour of such a cam 1 includes a circular portion 4 of the cam bottom with a cam bottom radius R and a cam apex portion 6 that is eccentric to it. In the rotary position of the cam 1 shown in the drawing, the cam apex portion 6 is in contact with a rolling face 8 of a cup tappet 10, which transmits the rotary motion of the cam 1 to the associated gas exchange valve in the form of a linear reciprocating motion.

According to the invention, for variable adjustment of the cam contour, a pressure-fluid-actuated piston 12 is provided, which is guided by the cam 1 and is radially retractable and extensible continuously and which on its end forms at least a part of the cam apex portion 6. In a preferred embodiment, the radial position of the piston 12 is adjustable as a function of the force equilibrium between spring forces that urge the piston 12 radially inward and pressure forces of a pressure fluid that urge it radially outward. The lubricant oil of the engine is preferably used as the pressure fluid.

The piston 12 is guided in a continuous stepped bore 16 of the cam 1, extending in the direction of the center axis 14 of the cam, and a helical spring 18 is braced on one end on a step 20, toward the cam apex, of the stepped bore 16 and on the other on an annular face 24 of the piston 12 pointing away from an action face 22 on the base of the piston; at the annular face, the piston 12 widens in stages in diameter. The piston 12 therefore comprises a smaller-diameter head portion 28, protruding in or through a portion 26 of the stepped bore 16 toward the cam apex and a bottom portion 30 of larger diameter that contains the action face 22. The helical spring 18 is then retained in an annular chamber 32 between the outer circumference of the head portion 28 of the piston 12 and the inner circumference of the larger-diameter portion 34 of the stepped bore 16.

Between the action face 22 on the base of the piston 12 and a stopper piece 36, inserted into the end, pointing away from the cam apex portion 6, of the larger-diameter portion 34 of the stepped bore 16, there is a pressure chamber 38, which is in communication with a lubricant oil conduit 42 that is coaxial with the camshaft axis 40 and that connects the pressure chambers 38 of the cams 1 of the camshaft 2 to one another. The stopper piece 36 can be retained in the stepped bore 16, for instance by being screwed in place. A bush 44 open on its end and supported toward the cam apex on the stopper piece 36 acts as a radially inner stop for the piston 12 if there is a pressure drop in the pressure chamber 38, for instance in the event of a failure of the pressure fluid supply or if the engine is stopped. In such cases, the piston 12 is urged against the bush 44 by the action of the helical spring 18 and is thus kept in a defined position. In order not to hinder the inflow of lubricant oil into the pressure chamber 38 or the further flow of lubricant oil to the pressure chamber of the next cam, the bush 44 has openings in its circumferential wall that are aligned with the openings in the lubricant oil conduit 42. Alternatively, the bush 44 may form an integral component with the stopper piece 36. Radially outward, the stroke of the piston 12 is limited by the compressed winding package of the helical spring 18 that is braced against the step 20.

To assure favorable rolling performance of the cam apex portion 6 on the rolling face 8 of the cup tappet 10, the cam apex end 46 of the piston 12 is embodied spherically. In a preferred way, a ball 48 that can roll along the rolling face 8 of the cup tappet 10 is rotatably supported on the cam apex end 46 of the piston 12. To that end, a spherical bearing face 50 corresponding to the radius of the ball 48 is embodied on the cam apex end 46 of the piston 12, and its edge 52 is crimped radially inward in order to grasp the ball 48. The bearing face 50 of the ball 48 is supplied with lubricant oil by the lubricant oil system of the engine, to which end the piston 12 has a central conduit 54 connecting the bearing face 50 of the ball 48 with the pressure chamber 38.

The pressure buildup and pressure reduction in the pressure chambers 38 of the cams 1 that are provided with retractable and extensible pistons 12 is effected by means of a valve assembly, not shown for reasons of scale, which for instance contains one switching valve each upstream of the lubricant oil conduit 42 of the camshaft 2 and one switching valve each downstream of the lubricant oil conduit 42.

With this background, the function of the device according to the invention for variable control of gas exchange valves of an internal combustion engine can be described as follows:

As a function of a characteristic curve, by means of the valve assembly, a lubricant oil pressure for generating pressure forces at the action faces 22 of the pistons 12 is established in the lubricant oil conduit 42, or in the pressure chambers 38 connected to it, by the engine controller; these pressure forces, in force equilibrium with the spring forces of the helical springs 18, bring about a defined common radial position of all the pistons 12 relative to the cams 1 associated with them. The resultant radial position of the pistons 12 is suited to the desired valve strokes, valve opening times, and valve opening speeds. For continuous adjustment of these parameters, only the lubricant oil pressure in the pressure chambers 38 needs to be adapted accordingly, so that a new radial position of the pistons 12 can be established.

In the preferred embodiment of the invention described above, for adjusting the radial position of the pistons 12, spring means 18 acting on one end are used. In a further embodiment, however, spring means could act on the pistons 12 on both ends, and the pressure fluid could additionally act on one end. As a further variant, at least some of the pistons could be embodied as differential pistons which are acted upon by pressure fluid on both ends. Spring means can also be provided in addition, which act to reinforce one or both directions of motion of the pistons and which urge the pistons into a defined position and keep them there if the pressure fluid supply fails.

I claim:

1. A device for variable control of the gas exchange valves of an internal combustion engine, the device including a cam having a cam contour with a circular portion (4) at the cam bottom and a cam apex portion (6), and a pressure-fluid-actuated piston (12), guided by the cam (1) for continuous radial retractable and extensible movement for variously adjusting the cam, the piston having an end which forms at least a part of the cam apex portion (6), wherein the end (46) of the piston (12) toward the cam apex is embodied as essentially spherical.

2. The device of claim 1, wherein the piston (12) is kept in a defined position if the pressure fluid supply fails.

3. The device of claim 2, further comprising a ball (48) that is capable of rolling on a rolling face (8) of a tappet (10) that cooperates with the applicable cam (1), the ball (48) being rotatably supported on the end (46) of the piston (12) toward the cam apex.

4. The device of claim 3, further comprising a spherical bearing face (50) corresponding to the radius of the ball (48) embodied on the end (46) of the piston (12) toward the cam apex, its edge (52) of the bearing face (50) being crimped radially inward in order to grasp the ball (48).

5. The device of claim 4, wherein the bearing face (50) of the ball (48) is supplied with lubricant oil by the lubricant oil system of the engine.

6. The device of claim 5, wherein the piston (12) in the cam (1) is guided linearly and is actuated by lubricant oil of the engine.

7. The device of claim 6, further comprising a spring (18) engaging the piston (12), the radial position of the piston (12) being adjustable as a function of the force equilibrium between forces of the spring (18) that urge the piston (12) radially inward and pressure forces of the lubricant oil that urge it radially outward.

8. The device of claim 6, further comprising a continuous stepped bore (16) that extends in the direction of the center axis (14) of the cam, the piston (12) being guided in the bore (16), and the helical spring (18) being braced on one end on a step (20), toward the cam apex, of the stepped bore (16) and on the other on an annular face (24) of the piston (12) pointing away from an action face (22) on the base of the piston.

9. The device of claim 7, further comprising a continuous stepped bore (16) that extends in the direction of the center axis (14) of the cam, the piston (12) being guided in the bore (16), and the helical spring (18) being braced on one end on a step (20), toward the cam apex, of the stepped bore (16) and on the other on an annular face (24) of the piston (12) pointing away from an action face (22) on the base of the piston.

10. The device of claim 8, wherein between the action face (22) of the piston (12) and a stopper piece (36) inserted into the end of the stepped bore (16) pointing away from the cam apex portion (6), a pressure chamber (38) for the lubricant oil is embodied, which communicates with a lubricant oil conduit (42) that is coaxial with the camshaft axis (40).

11. The device of claim 10, further comprising a bush (44) inserted into the stepped bore (16) and braced on the stopper piece (36), the bush (44) serving as a radially inner stop for the piston (12).

12. The device of claim 9, wherein the piston (12) has a conduit (54) connecting the bearing face (50) of the ball (48) with the pressure chamber (38).

13. The device of claim 11, wherein the piston (12) has a conduit (54) connecting the bearing face (50) of the ball (48) with the pressure chamber (38).

14. The device of claim 1, wherein the pressure buildup or pressure reduction in the pressure chambers (38) of the cams (1) that are provided with retractable and extensible pistons (12) is effected by means of a valve assembly that contains one switching valve upstream of the lubricant oil conduit (42) of the camshaft (2) and one switching valve downstream of the lubricant oil conduit (42).

15. The device of claim 2, wherein the pressure buildup or pressure reduction in the pressure chambers (38) of the cams (1) that are provided with retractable and extensible pistons (12) is effected by means of a valve assembly that contains one switching valve upstream of the lubricant oil conduit (42) of the camshaft (2) and one switching valve downstream of the lubricant oil conduit (42).

16. The device of claim 7, wherein the pressure buildup or pressure reduction in the pressure chambers (38) of the cams (1) that are provided with retractable and extensible pistons (12) is effected by means of a valve assembly that contains one switching valve upstream of the lubricant oil conduit (42) of the camshaft (2) and one switching valve downstream of the lubricant oil conduit (42).

17. The device of claim 8, wherein the pressure buildup or pressure reduction in the pressure chambers (38) of the cams (1) that are provided with retractable and extensible pistons (12) is effected by means of a valve assembly that contains one switching valve upstream of the lubricant oil conduit (42) of the camshaft (2) and one switching valve downstream of the lubricant oil conduit (42).

18. The device of claim 9, wherein the pressure buildup or pressure reduction in the pressure chambers (38) of the cams (1) that are provided with retractable and extensible pistons (12) is effected by means of a valve assembly that contains one switching valve upstream of the lubricant oil conduit (42) of the camshaft (2) and one switching valve downstream of the lubricant oil conduit (42).

* * * * *